US008468848B2

(12) United States Patent
Kwon

(10) Patent No.: US 8,468,848 B2
(45) Date of Patent: Jun. 25, 2013

(54) REFRIGERATOR

(75) Inventor: Ohchul Kwon, Gyeongsangnam-do (KR)

(73) Assignee: LG Electronics Inc., Seoul (KR)

( * ) Notice: Subject to any disclaimer, the term of this patent is extended or adjusted under 35 U.S.C. 154(b) by 235 days.

(21) Appl. No.: 12/864,992

(22) PCT Filed: Jan. 20, 2009

(86) PCT No.: PCT/KR2009/000299

§ 371 (c)(1),
(2), (4) Date: Jul. 28, 2010

(87) PCT Pub. No.: WO2009/116727

PCT Pub. Date: Sep. 24, 2009

(65) Prior Publication Data

US 2010/0326116 A1 Dec. 30, 2010

(30) Foreign Application Priority Data

Mar. 17, 2008 (KR) ..... 10-2008-0024406

(51) Int. Cl.
*F25D 11/02* (2006.01)
*F25D 21/14* (2006.01)

(52) U.S. Cl.
USPC ..... 62/443; 62/447; 62/285; 62/291

(58) Field of Classification Search
USPC ..... 62/106, 335, 443, 444, 445, 446, 62/467, 468, 469, 470, 471
See application file for complete search history.

(56) References Cited

U.S. PATENT DOCUMENTS

| | | | | |
|---|---|---|---|---|
| 2,994,208 | A | 8/1961 | Hanson | |
| 5,465,591 | A * | 11/1995 | Cur et al. | 62/439 |
| 5,499,514 | A * | 3/1996 | Ho | 62/291 |
| 6,209,342 | B1 * | 4/2001 | Banicevic et al. | 62/443 |
| 8,033,130 | B2 * | 10/2011 | Cho et al. | 62/275 |
| 2008/0000260 | A1 * | 1/2008 | Lim et al. | 62/465 |

FOREIGN PATENT DOCUMENTS

| | | | |
|---|---|---|---|
| CN | 1138906 | A | 12/1996 |
| JP | 17-090924 | A | 4/2005 |
| JP | 2005090924 | A | 4/2005 |
| KR | 10-20020014212 | A | 2/2002 |
| KR | 2002014212 | A | 2/2002 |
| KR | 10-0398497 | B1 | 9/2003 |
| KR | 10-0525399 | B | 11/2005 |
| KR | 10-0657933 | B1 | 12/2006 |
| KR | 657933 | B1 | 12/2006 |
| KR | 10-0698237 | B1 | 3/2007 |
| KR | 698237 | B1 | 3/2007 |

OTHER PUBLICATIONS

Chinese Office Action dated Sep. 26, 2011 for Application No. 200980104783.5, with English translation, 12 pages.

(Continued)

*Primary Examiner* — Judy Swann
*Assistant Examiner* — Zachary Anderegg
(74) *Attorney, Agent, or Firm* — Fish & Richardson P.C.

(57) ABSTRACT

The present invention relates to a refrigerator in which an evaporator is mounted in an inside of a barrier partitioning a freezing chamber and a refrigerating chamber. With the refrigerator according to the embodiment of the present invention, the evaporator for cooling the refrigerating chamber is received in the barrier portioning the freezing chamber and the refrigerating chamber, making it possible to increase inner capacity of the refrigerating chamber.

11 Claims, 3 Drawing Sheets

OTHER PUBLICATIONS
International Search Report dated Aug. 27, 2009 for Application No. PCT/KR2009/000299, 2 pages.
Korean Office Action issued in Application No. 10-2008-0024406, mailed Feb. 18, 2009, 5 pages.
Chinese Office Action dated Jan. 11, 2013 for Application No. 200980104783.5 with English Translation, 16 pages.

* cited by examiner

REFRIGERATOR

TECHNICAL FIELD

The present invention relates to a refrigerator.

BACKGROUND ART

Generally, a refrigerator is a home appliance which stores foods at a low temperature so that foods can be maintained in a fresh condition for a long time.

More specifically, a refrigerator is provided with a refrigerating chamber in which a temperature is maintained in the range of 1 to 4° C. to store foods such as vegetables in a fresh condition, and a freezing chamber in which a temperature is maintained in the range of −18 to store foods such as meats and fishes in a freezing condition.

According to a position of a refrigerating chamber and a freezing chamber, a refrigerator is sorted as a top mount type where the freezing chamber is positioned on the upper side of the refrigerating chamber, a bottom freezer type where the freezing chamber is positioned on the lower side of the refrigerating chamber, and a side by side type where the refrigerating chamber and the freezing chamber are provided adjacent to each other side by side.

According to a manner that a door is provided, a refrigerator may also be sorted as a side by side refrigerator where doors are arranged side by side, and a vertical type refrigerator where doors each are arranged up and down.

According to a manner that an evaporator is installed, a refrigerator may also be sorted as a type where one evaporator is provided in a freezing chamber side and a type where each evaporator is provided in a freezing chamber and a refrigerating chamber.

More specifically, in the case of the side by side type refrigerator, it is partitioned side by side by a barrier formed from a ceiling surface of a main body to a bottom surface thereof so that a freezing chamber is provided in one side and a refrigerating chamber is provided in the other side.

Recently, a side by side type refrigerator where an evaporator is received in the barrier has been also developed. However, in this case, in order to supply cold air generated from one evaporator to both the freezing chamber and the refrigerating chamber, a flow passage for the movement of air is formed in the barrier to lead to the complexity of the barrier structure and the number of the manufacturing process is increased to lead to the deterioration of productivity.

Also, when the evaporator is completely received in the inner side of the barrier, the thickness of the insulating layer stuffed in the barrier becomes thin to lead to the deterioration of insulation performance.

Meanwhile, a side by side type refrigerator having each evaporator in a refrigerating chamber and a freezing chamber has also been developed. In this case, the evaporator for freezing chamber is mounted to a rear wall of the freezing chamber and the evaporator for refrigerating chamber is mounted to a rear wall of the refrigerating chamber.

When the evaporator for refrigerating chamber is mounted to the rear wall of the refrigerating chamber as described above, a space for receiving the evaporator is provided on a rear wall of an inner case. As a result, the forward and backward length of the refrigerating chamber is reduced and thus, a problem arises in that the receiving space of the refrigerating chamber becomes narrow to the extent corresponding to the receiving space of the evaporator.

DISCLOSURE OF INVENTION

Technical Problem

The present invention is proposed to solve the problem. An object of the present invention is to provide a refrigerator capable of increasing an inner capacity, when an evaporator for freezing chamber and an evaporator for refrigerating chamber are provided, respectively.

Another object of the present invention is to provide a refrigerator capable of having a simple structure and maintaining an insulation performance, while providing an evaporator to a barrier partitioning a freezing chamber and a refrigerating chamber.

Another object of the present invention is to provide a refrigerator in which shelves and drawers can be easily drawn in and out by utilizing the constitution related to an evaporator provided to the barrier.

Technical Solution

In order to accomplish the objects, a refrigerator according to the embodiment of the present invention comprises: a main body; a barrier partitioning the inside of the main body into a refrigerating chamber and a freezing chamber; an evaporator provided in the inside of the barrier; a cooling fan provided on the upper side of the evaporator; a cover covering the cooling fan and the evaporator; and a guide part provided on the external surface of the cover to support a shelf or a drawer.

Advantageous Effects

With the refrigerator according to the embodiment of the present invention constituted as above, the evaporator is provided to one side of the barrier partitioning the freezing chamber and the refrigerating chamber, making it possible to increase inner volume compared to the prior art.

Also, the evaporator for freezing chamber for cooling the freezing chamber and the evaporator for refrigerating chamber for cooling the refrigerating chamber are provided, respectively, making it possible to simplify the structure of the barrier and maintain the insulation performance of the barrier.

Also, the structure of the cover of the evaporator mounted to the barrier is improved, making it possible to easily draw in and out a shelf or drawer storing foods.

BRIEF DESCRIPTION OF THE DRAWINGS

The above and other objects, features and advantages of the present invention will become apparent from the following description of preferred embodiments given in conjunction with the accompanying drawings, in which.

BEST MODE FOR CARRYING OUT THE INVENTION

Hereinafter, preferred embodiments will be described in detail with reference to the accompanying drawings. However, the idea of the present invention is not limited to the proposed embodiments but other embodiments included in other retrograde invention or in the scope of the present invention can be easily proposed by adding, modifying and deleting other constituents.

Figure 1:
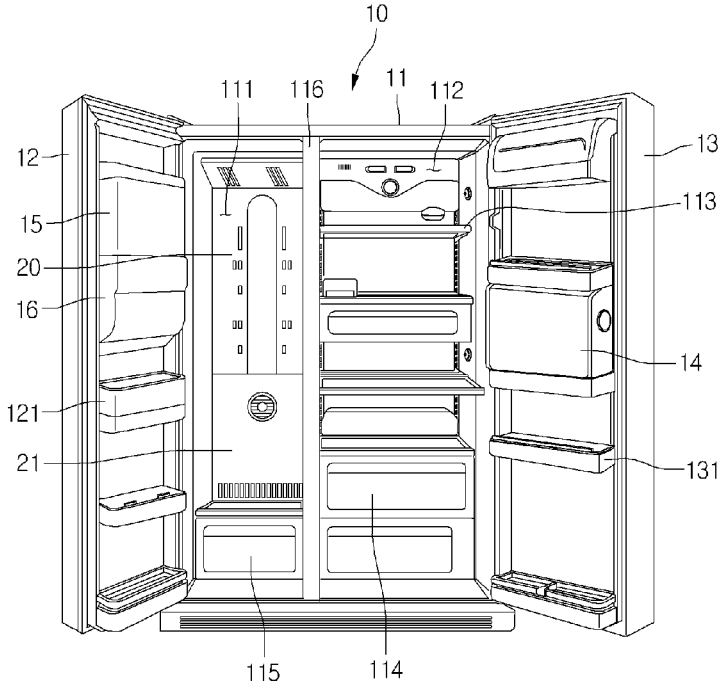
FIG. 1 is a perspective view showing an inner structure of a refrigerator equipped with an evaporation mounting structure according to an embodiment of the present invention.

FIG. 1 is a perspective view showing an inner structure of a refrigerator equipped with an evaporation mounting structure according to an embodiment of the present invention.

Referring to FIG. 1, the refrigerator 10 according to the embodiment of the present invention includes a main body 11 provided with a freezing chamber 111 and a refrigerating chamber 112, and a freezing chamber door 12 and a refrigerating chamber door 13 rotatably provided to the front surface of the main body 11 and selectively opening and closing the freezing chamber 111 and the refrigerating chamber 112. The freezing chamber 111 and the refrigerating chamber 112 are partitioned side by side.

More specifically, a freezing duct 20 supplying cold air generated from an evaporator to the freezing chamber 111 is mounted to a rear wall of the freezing chamber 111. And, a freezing evaporator (not shown) for cooling the freezing chamber is mounted on the lower side of the freezing duct 20, and the freezing evaporator is shielded by a freezing evaporator cover 21. Therefore, the cold air generated from the freezing evaporator rises along the freezing duct 20 to be discharged into the inside of the freezing chamber 111 through an outlet port formed on the freezing duct 20.

The cold air discharged into the inside of the freezing chamber 111 circulates the freezing chamber 111 and then moves again to the freezing evaporator through an inlet port provided in the lower side of the freezing evaporator cover 21. In other words, the air inside the freezing chamber 111 circulates, independently from the refrigerating chamber 112.

Also, a door basket 121 for receiving foods may be mounted on a rear surface of the freezing chamber door 12, and an ice-making apparatus 15 may be mounted on the rear surface of the freezing chamber door 12. And, when the ice-making apparatus 15 is mounted on the rear surface of the freezing chamber door 12, a discharge duct 16 may be provided on the lower side of the ice-making apparatus 15. The discharge duct 16 is a path that ice made in the ice-making apparatus 15 is discharged to the outside of the refrigerator 10. And, a dispenser apparatus (not shown) is provided on the front surface of the freezing chamber door 12 on the position corresponding to an end of the discharge duct 16. Therefore, the ice made in the ice-making apparatus 15 can be taken out even from the external, without opening the freezing chamber door 12. And, an ice-making tray and an ice bank in which the completed ice is stored are provided inside the ice-making apparatus 15.

Also, drawers 115 and 114 for receiving foods and a shelf 113 on which foods are put may be provided in the freezing chamber 111 and the refrigerating chamber 112.

Also, a door basket 131 for receiving foods may be provided even on a rear surface of the refrigerating door 13, and a home bar 14 may also be provided according to the sort of products. The home bar 14 has a structure that foods stored therein, in particular, beverage, can be taken out without opening the refrigerating chamber door 13.

Hereinafter, a structure that a refrigerating evaporator for cooling the refrigerating chamber is mounted to the barrier 116 will be described in detail with reference to the drawings. Of course, the freezing chamber evaporator may also be used as the evaporator mounted to the barrier 116.

Figure 2:
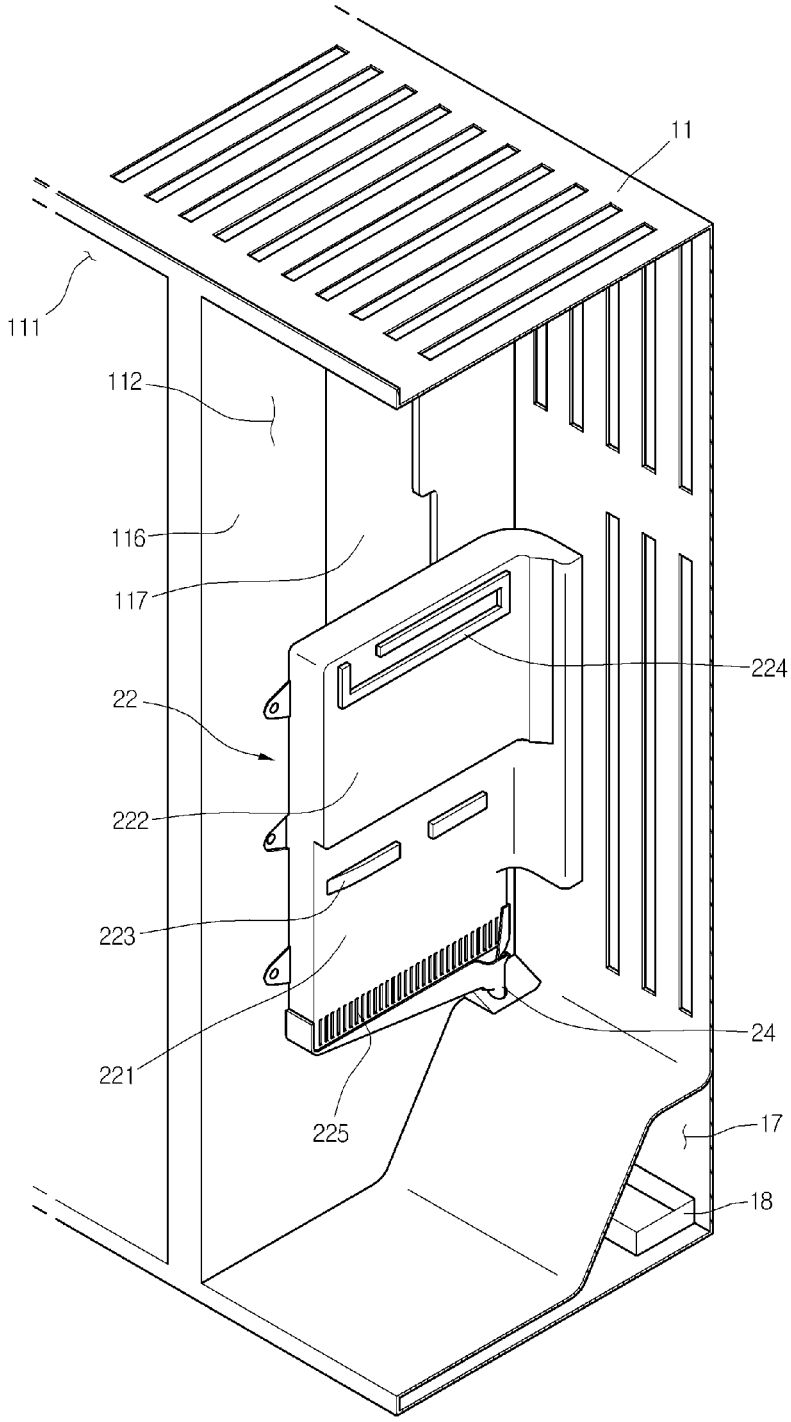
FIG. 2 is an inner perspective view of a refrigerator showing a constitution that an evaporator is mounted to a barrier of a refrigerator according to an embodiment of the present invention.

FIG. 2 is an inner perspective view of a refrigerator showing a constitution that an evaporator is mounted to a barrier of a refrigerator according to an embodiment of the present invention.

Referring to FIG. 2, the refrigerating chamber 112 of the refrigerator 10 according to the embodiment of the present invention is partitioned from the freezing chamber 111 by the barrier 116.

More specifically, the barrier 116 is extended from the upper end of the main body 11 to the lower end thereof to partition the storage space inside the main body 11 side by side. And, in the inner side of the barrier 116, an insulating layer stuffed with a foaming agent is provided so that a heat transfer between the freezing chamber 111 and the refrigerating chamber 112 is blocked.

A refrigerating evaporator 23 (see FIG. 3) is mounted on the refrigerating chamber side of the barrier 116, and the refrigerating evaporator 23 is covered with a refrigerating evaporator cover 22. Therefore, when the refrigerating chamber door 13 is opened, the refrigerating evaporator 23 is not exposed to the external.

Also, a refrigerating duct 117 is formed on the upper side of the refrigerating evaporator, and the refrigerating duct 118 is indented from the barrier 116 side to the inner side at a predetermined depth. And, a duct cover (not shown) is mounted to the cooling duct 117 so that a complete one cold air flow passage is formed. And, in the duct cover, cold air outlet ports upward and downward spaced from each other at a predetermined interval are formed. Therefore, the cold air is evenly provided to the entire space of the refrigerating chamber 112.

Meanwhile, a machine chamber 17 is provided on the lower end of the main body 11 of the refrigerator 10, and a pressure, a condenser and other machine components are received in the machine chamber 17, wherein a main drain pan is provided on the bottom of the machine chamber 17 to collect condensed water generated from the refrigerating evaporator and the freezing evaporator. And, a sub-drain pan 24 for receiving condensed water is mounted on the lower end of the refrigerating evaporator. And, a drain hole 119 (see FIG. 3) is formed on a bottom surface of the refrigerating chamber 112, that is, on a surface corresponding to a ceiling part of the machine chamber 17. And, the sub-drain pan 24 is connected to the drain hole 119. Therefore, the condensed water collected in the sub-drain pan 24 is collected in the main drain pan 18 through the drain hole 119.

A cooling fan for blowing the generated cold air is mounted to the upper side of the refrigerating evaporator to the refrigerating duct 117. And, the refrigerating fan is covered with the refrigerating evaporator cover 22. In other words, the refrigerating evaporator cover 22 may be formed of a fan covering part 222 and an evaporator covering part 221.

At least one of a guide rib 223 supporting a side of a drawer drawably provided to the refrigerating chamber 112 or a guide rail 224 may be formed on the external surface of the refrigerating evaporator cover 22. And, an inhalation grill 225 is formed on the lower end of the refrigerating evaporator cover 22 to allow the cold air supplied to the inside of the refrigerating chamber 112 to be returned to the refrigerating evaporator. In other words, air inside the refrigerating chamber 112 circulates, independently from the freezing chamber 111.

Figure 3:
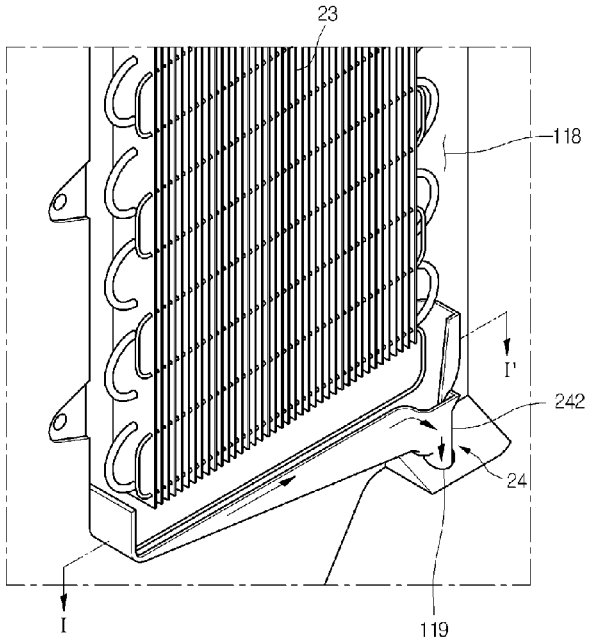
FIG. 3 is a perspective view showing a barrier structure in a state where the cover of the evaporator for refrigerating chamber of FIG. 2 is removed.
Figure 4:
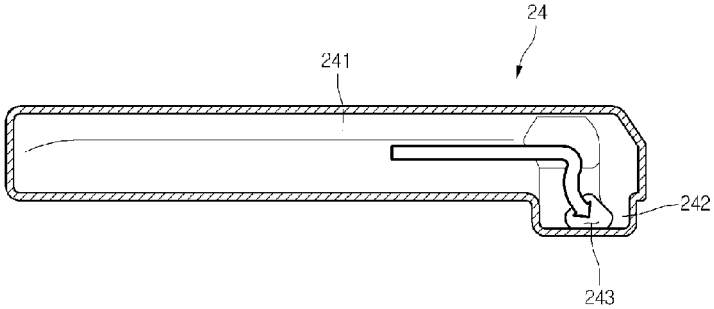
FIG. 4 is a cross-sectional view taken along lines I-I' of FIG. 3.

FIG. 3 is a perspective view showing a barrier structure in a state where the cover of the evaporator for refrigerating chamber of FIG. 2 is removed, and FIG. 4 is a cross-sectional view taken along lines I-I' of FIG. 3.

Referring to FIGS. 3 and 4, an evaporator receiving part 118 for seating the refrigerating evaporator 23 is indented on one side of the barrier 116 at a predetermined depth.

The evaporator receiving part 118 is indented by the smaller length compared to the thickness of the refrigerating evaporator 23 to allow only a portion of the refrigerating evaporator 23 to be received. In this case, the reduction in the thickness of the insulating layer provided inside the barrier 116 can be minimized, making it possible to maintain insulation performance.

Meanwhile, a sub-drain pan 24 for receiving condensed water is mounted on the lower end of the refrigerating evaporator 23. And, the sub-drain pan 24 includes a water collection part 241 extended from the front of the barrier 116 to the rear thereof, and a drain part 242 extended from the rear end of the water collection part 241 to the lower side thereof. A discharge hole 243 is formed in the drain part 242, and the drain part is inserted to a drain hole 119 formed on the bottom surface of the refrigerating chamber 112.

Here, the drain hole 119 is formed on the bottom surface of the refrigerating chamber 112 on the position spaced from the barrier 116 at a predetermined interval. Therefore, the drain part is extended in the direction from the rear end of the water collection part 241 to the drain hole 119 and then is extended downwardly.

With the constitution as described above, the condensed water on the surface of the refrigerating evaporator 23 falls to be collected in the water collection part 241. And, the water collection part 241 is inclined to the drain part 242 so that the condensed water collected in the water collection part 241 flows to the drain part 242. And, the condensed water falls to the drain hole 119 through the drain part 242 to be collected in the main drain pan 18.

Figure 5:
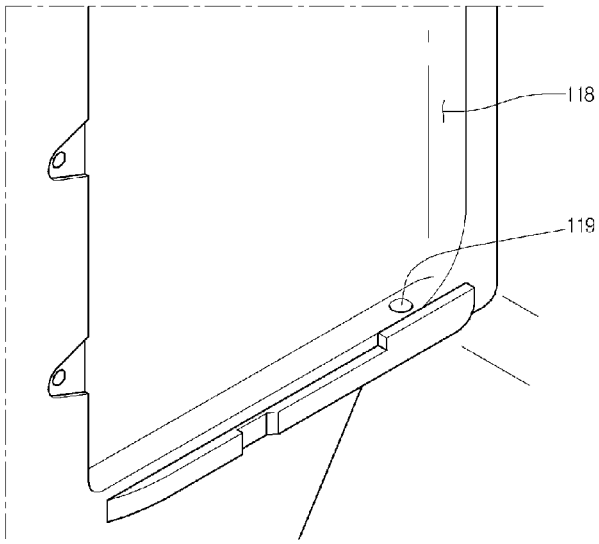
FIG. 5 is a partial perspective view showing an evaporator mounting structure according to another embodiment of the present invention.

FIG. 5 is a partial perspective view showing an evaporator mounting structure according to another embodiment of the present invention.

Referring to FIG. 5, the present embodiment has the same constitutions as those described above but is characterized in that a position of the drain hole 119 is different.

More specifically, the drain hole 119 is formed on the rear edge of the bottom surface of the evaporator receiving part, differently from the previous embodiment. Therefore, the drain part 242 of the sub-drain pan 24 is not required to be extended to the center direction of the refrigerating chamber. Furthermore, the drain part 242 is not exposed to the external in a state where the refrigerating evaporator cover 22 is mounted.

Also, the drain hole 119 is formed in the evaporator receiving part 118 so that a separate sub-drain pan may not be required. In other words, when the refrigerating evaporator cover 22 is mounted, if the condensed water is not leaked by increasing the tightness of the surface contacting the surface of the barrier 116, a separate drain pan may not be required.

Here, the evaporator mounted to the barrier 116 may be an evaporator for freezing chamber, the evaporator mounted to the rear wall may be referred to as a first evaporator and the evaporator mounted to the barrier may be referred to as a second evaporator. In other words, in the present invention, the freezing evaporator may correspond to the first evaporator, and the refrigerating evaporator 23 may correspond to the second evaporator.

As the respective evaporators are independently provided to the freezing chamber 111 and the refrigerating chamber 112 as described above, a cold storage of foods can be made at optimum temperature.

In particular, air inside the freezing chamber 111 circulates only in the freezing chamber 111 and air inside the refrigerating chamber 112 circulates only in the refrigerating chamber 111, such that there is no need to form a structure for movement of air in the barrier 116.

Therefore, the structure of the barrier 116 is simplified. More specifically, there is no need to provide a separate structure in the inside of the barrier 116 stuffed with insulating material, such that the manufacturing process becomes more simplified compared to the structure that an evaporator is provided to the barrier of the conventional side by side type refrigerator, thereby having a remarkable effect that the productivity of the product is improved.

Also, only a portion of the refrigerating evaporator 23 is received in the barrier 116, making it possible to minimize the reduction in thickness of the insulating layer formed inside the barrier 116. Therefore, insulation performance between the freezing chamber 111 and the refrigerating chamber 112 can be maintained.

Also, the guide rib 223 or the guide rack 224 is provided to the external surface of the refrigerating evaporator cover 22 so that a shelf or a drawer is provided even in a position where the refrigerating evaporator 23 is provided, making it possible to improve space utilization.

Also, the refrigerating evaporator 23 is received inside the barrier 16, having an effect that the forward and backward length of the refrigerating chamber 112 or the freezing chamber 111 becomes longer than that of the prior art. Therefore, more foods can be put on the shelf of the refrigerating chamber and the capacity of the drawer of the refrigerating chamber can be increased.

The invention claimed is:

1. A refrigerator comprising:

a main body;

a barrier extending from an upper end of the main body to a lower end thereof to partition storage space inside the main body side by side, thereby partitioning the inside of the main body into a first chamber and a second chamber, and an insulating layer is provided in the barrier, the barrier comprising a receiving part which is indented on a wall of the barrier to a predetermined depth and an air duct extended from the receiving part upward;

a first evaporator provided on a rear wall of the first chamber;

a second evaporator mounted to the wall of the barrier on a side of the second chamber, the second evaporator comprising a first portion received in the receiving part and a second portion protruded from the wall of the barrier to an inner direction of the second chamber;

a cooling fan provided in the air duct to generate an air flow which passes through the second evaporator;

a cover covering the first and second portions of the second evaporator and the cooling fan; and a guide part provided on an external surface of the cover to support a drawer, the guide part comprising at least one of a guide rib and a guide rail configured to support a side of the drawer drawably provided to the second chamber.

2. The refrigerator according to claim 1, wherein the barrier blocks air inside the first chamber and air inside the second chamber from being communicated with each other.

3. The refrigerator according to claim 1, wherein the first chamber is a freezing chamber and the second chamber is a refrigerating chamber.

4. The refrigerator according to claim 1, wherein the guide part includes a guide rib protruded from an external surface of the cover and extended forward and backward.

5. The refrigerator according to claim 1, wherein the guide part includes a guide rail provided in an outer surface of the cover.

6. The refrigerator according to claim 1, wherein an inhalation grill is formed on a lower end of the cover.

7. The refrigerator according to claim 1, further comprising:

a drain pan provided on a lower end of the second evaporator to collect condensed water.

8. The refrigerator according to claim 1, wherein the external surface of the cover on which the guide part is provided is oriented parallel to the barrier.

9. The refrigerator according to claim 1, wherein the external surface of the cover on which the guide part is provided is oriented parallel to the barrier.

10. The refrigerator according to claim 7, wherein a drain hole is formed on a bottom surface of the second chamber on a position spaced from a space where the second evaporator is provided, and the drain pan is connected to the drain hole.

11. The refrigerator according to claim 7, wherein a drain hole is formed on the bottom surface of the second chamber, and the drain pan is connected to the drain hole.

* * * * *